US006253714B1

(12) United States Patent
Klein

(10) Patent No.: US 6,253,714 B1
(45) Date of Patent: Jul. 3, 2001

(54) STEAM GENERATOR

(75) Inventor: Manfred Klein, Oberhausen (DE)

(73) Assignee: BBP Energy GmbH, Oberhausen (DE)

( * ) Notice: Subject to any disclaimer, the term of this patent is extended or adjusted under 35 U.S.C. 154(b) by 0 days.

(21) Appl. No.: 09/656,916

(22) Filed: Sep. 7, 2000

(30) Foreign Application Priority Data

Sep. 8, 1999 (DE) ..... 199 42 767

(51) Int. Cl.[7] ..... F22B 33/00

(52) U.S. Cl. ..... 122/1 A; 122/7 R; 122/DIG. 2; 110/216

(58) Field of Search ..... 122/7 R, 1 A, 122/1 R, DIG. 1, DIG. 2, 510; 110/254, 216

(56) References Cited

U.S. PATENT DOCUMENTS 5,207,164 * 5/1993 Breen et al. ..... 110/216

5,320,052 * 6/1994 Spokoyny et al. ..... 110/216

FOREIGN PATENT DOCUMENTS

1280264A * 12/1986 (SU) ..... 122/DIG. 2

* cited by examiner

*Primary Examiner*—Jiping Lu
(74) *Attorney, Agent, or Firm*—Max Fogiel

(57) ABSTRACT

A steam generator with a stack of coal-dust burners (4), each of which accommodates a removable oil lance, and with one or more flues (3) that communicate with a combustion-air heater (6). The heater rests on a scaffolding (12) and has flue gas flowing through it, its flue-as outlet (9) communicating by way of a distriutor (20) with an electric filter (16). The filter is provided with a housing (17) and with one or more intake hoods (18). The distributor is upright and below the heater's flue-gas outlet and the heater is above where the lances can be removed from the burners.

5 Claims, 2 Drawing Sheets

STEAM GENERATOR

BACKGROUND OF THE INVENTION

The present invention concerns a steam generator with a stack of coal-dust burners.

A steam generator of this genus is known from VGB Kraftswerktechnik 73 (1993) 917-32 for example. The outlet section of its combustion-air heater communicates with a filter-intake hood through a horizontal distributor. The air heater is on the same level as the coal-dust burner which is accommodated in a boxing attitude on two facing walls of the combustion chamber. Oil-injection lances are employed in the burner to ignite the coal dust. The lances can be removed when necessary, and space is accordingly provided for that purpose on the same level as the burner and between the wall of the combustion chamber and the air heater. The accommodation of the heater on the same level as the burner and the horizontal orientation of the distributors consume a lot of space, however, and result in considerable complexity.

SUMMARY OF THE INVENTION

The object of the present invention is a steam generator of the aforesaid genus that will be simpler but entail no sacrifice in quality.

The vertical orientation of the distributor and the new position of the air heater above the burner reduces the amount of space required by the steam generator in two ways. First, space is no longer needed between the intake hood of the electric filter and the rear wall to accommodate the air heater. Second, the heater can now be located near the combustion chamber. The extension or scaffolding that accommodates the heater need not be as tall, and less steel will be used.

BRIEF DESCRIPTION OF THE DRAWINGS

The present invention will now be specified with reference to the accompanying drawing, wherein.

DESCRIPTION OF THE PREFERRED EMBODIMENTS

Figure 1:
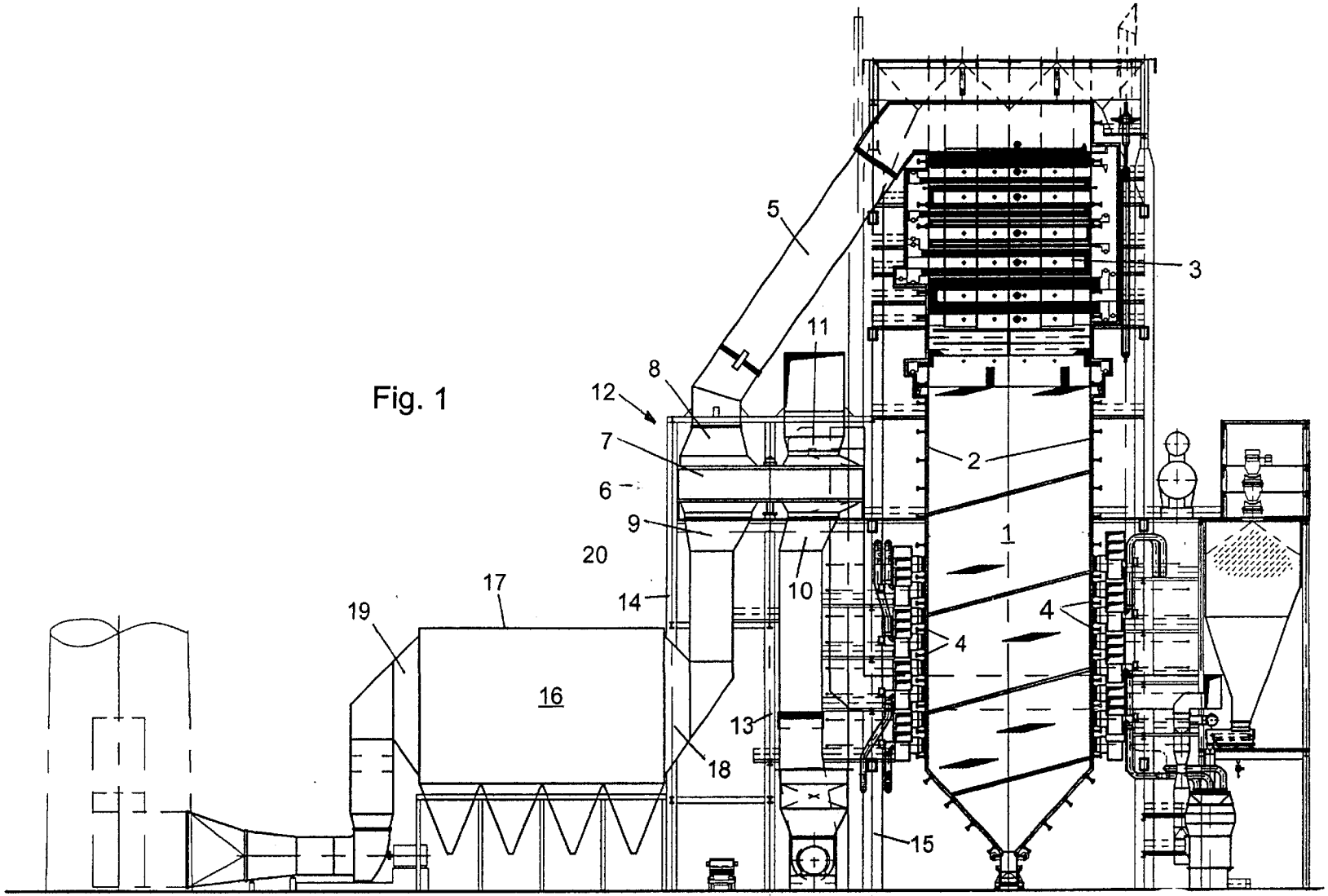
FIG. 1 is a frontal view of a steam generator and FIG. 2 is an overhead view of the steam generator illustrated in FIG. 1.
Figure 2:
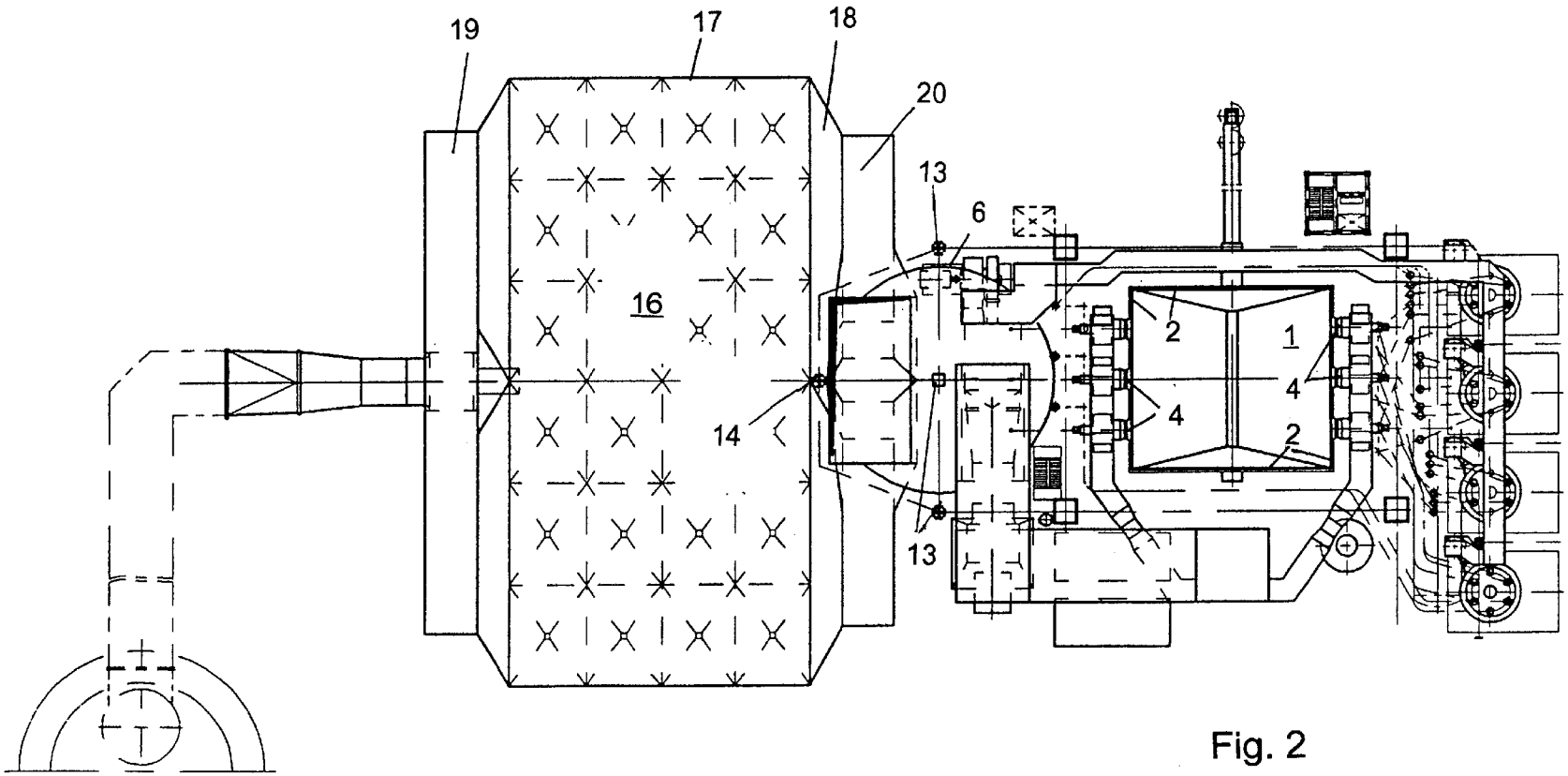

The steam generator is in the form of a columnar boiler. It is provided with a combustion chamber 1 demarcated by walls 2. A flue 3 communicates with walls 2. The generator can also be constructed in the form of a multiple-boiler device with several flues.

Coal-dust burners 4 are stacked between the opposing walls 2 of combustion chamber 1. Coal dust is burned inside combustion chamber 1 with preliminarily heated combustion air. Oil-injection lances are accommodated in a known manner along the axis of the burner to promote ignition of the dust, These lances must be removed from the burner for maintenance from time to time, and enough space must accordingly be left behind the burners for that purpose.

One or more lines 5 for removing the flue gas that forms in combustion chamber 1 connect the single or farthest downstream flue 3 to a combustion-air heater 6 with a cylindrical housing 7. Housing 7 accommodates a rotor provided with inertial masses. Housing 7 is also provided with a flue-gas intake 8, a flue-gas outlet 9, a combustion-air intake 10, and a combustion-air outlet 11.

Combustion-air heater 6 is accommodated in a tall scaffolding 12. Scaffolding 12 rests on a foundation by supports 13 and 14 and is attached to another scaffolding 15 that accommodates the steam generator. Heater 6 is situated above uppermost burner 4 and accordingly above where the lances can be removed for maintenance.

Since the removal of the lances requires no extra space in the present invention, heater 6 has been accommodated in the vicinity of a wall 2. Heater scaffolding 12 is accordingly as tall as the distance between the rear wall of heater 6 and the axis of the supports that support boiler scaffolding 15.

Downstream of air heater 6 is an electronic flue-gas filter 16. Filter 16 is provided with a filter housing 17 that is in turn provided with one or more filter-intake hoods 18 and with one or more filter-outlet hoods 19. The illustrated embodiment includes two intake and two outlet hoods.

Filter-outlet hoods 19 communicate by way of a distributor 20 with the air heater's flue gas outlet 9. Distributor 20 is accommodated upright inside heater scaffolding 12 below flue gas outlet 9.

Filter-intake hoods 18 extend into heater scaffolding 12. Filter housing 17 communicates tight upstream with the rear wall of heater 6. As compared with a conventional steam generator, which employs a horizontal distributor, accordingly, no space is needed between the rear wall of heater 6 and filter 16.

The rear of heater scaffolding 12 is in the form of a single support 14 extending along the geometrical projection of the longitudinal axis of filter 16 half-way between filter-intake hoods 18. Support 14 also helps support filter 16.

The steam generator in accordance with the present invention is not only simpler but also has a number of other advantages. The upright position of distributor 20 decreases friction and loss as the gas travels from the steam generator to filter 16 by way of combustion-air heater 6, decreasing the energy consumption of the overall plant. The vertical entry of the gas into filter 16 promotes major precipitation upstream thereof. Since the distributor is upright and not horizontal, no dust will accumulate therein at low outputs. There will accordingly be no backups upon return to full load and no static load will need to be taken into consideration in the distributor. The compensators accommodated in the upright distributor 20 will be less subject to contamination and erosion than those employed in horizontal lines.

The shorter distance between heater 6 and filter-intake hoods 18 on the one hand and the wall 2 of the combustion chamber on the other means that the overall system can be smaller, the foundation less expensive, and the cables and pipelines etc. that connect the system to its infrastructure shorter. The floors in heater scaffolding 12 can simultaneously function as access to filter 16 and as escape routes.

Vehicles can still travel between heater scaffolding 12 and filter 16 as usual in accordance with the present invention, and even beneath filter-intake hoods 18.

A flue-gas nitrogen remover can be installed in the vicinity of scaffolding 15.

If heater 6 needs to be rinsed now and then, baffles and foolers can be temporarily installed in filter-intake hoods 18 to protect filter 16 from moisture and to ensure drainage by way of intended routes.

What is claimed is:

1. A steam generator comprising:

a combustion chamber demarcated by walls and having at least one flue; a combustion-air heater communicating with said at least one flue and having flue gas flowing therethrough;

scaffolding supporting said combustion-air heater;

said combustion-air heater having a flue gas outlet; an electric filter communicating with said flue gas outlet through a vertical distributor line;

said electric filter having a housing and at least one intake hood; coal-dust burners on said walls demarcating said combustion chamber and having each an axis;

an oil injection lance removably mounted along the axis of each coal-dust burner;

said distributor line being located vertically upright inside said scaffolding and below said flue-gas outlet;

said filter intake hoods extending into said scaffolding, said oil injection lance being removable from said coal-dust burner at a location, said combustion air heater being positioned above said location where said oil injection lance is removable from said coal-dust burner for forming said oil injection lance from said coal-dust burner, said vertical distributor line entering said intake hood vertically, said intake hood extending into said scaffolding.

2. A steam generator as defined in claim 1, including a single support for said scaffolding at a location facing said electric filter, said electric filter having a longitudinal axis with a geometrical projection of the longitudinal axis, said single support being arranged in said geometrical projection of the longitudinal axis half-way between the filter-intake hoods.

3. A steam generator as defined in claim 1, wherein said housing communicates upstream with a rear wall of said combustion-air heater.

4. A steam generator comprising:

a combustion chamber demarcated by walls and having at least one flue;

a combustion-air heater communicating with said at least one flue and having flue gas flowing therethrough;

scaffolding supporting said combustion-air heater;

said combustion-air heater having a flue gas outlet;

an electric filter communicating with said flue gas outlet through a vertical distributor line;

said electric filter having a housing and at least one intake hood;

coal-dust burners on said walls demarcating said combustion chamber and having each an axis;

an oil injection lance removably mounted along the axis of each coal-dust burner;

said distributor line being located vertically upright inside said scaffolding and below said flue gas outlet;

said filter intake hoods extending into said scaffolding, said oil injection lance being removable from said coal-dust burner at a location said combustion air heater being positioned above said location where said oil injection lance is removable from said coal-dust burner for forming said oil injection lance from said coal-dust burner, said vertical distributor line entering said intake hood vertically, said intake hood extending into said scaffolding;

a single support for said scaffolding at a location facing said electric filter, said electric filter having a longitudinal axis with a geometrical projection of the longitudinal axis, said single supporting being arranged in said geometrical projection of the longitudinal axis half-way between the filter-intake hoods, said housing communicating upstream with a rear wall of said combustion-air heater.

5. A steam generator comprising:

a combustion chamber demarcated by walls and having at least one flue;

a combustion-air heater communicating with said at least one flue and having flue gas flowing therethrough;

scaffolding supporting said combustion-air heater;

said combustion-air heater having a flue gas outlet;

an electric filter communicating with said flue gas outlet through a vertical distributor line; said electric filter having a housing and at least one intake hood;

coal-dust burners on said walls demarcating said combustion chamber and having each an axis;

an oil injection lance removably mounted along the axis of each coal-dust burner;

said distributor line being located vertically upright inside said scaffolding and below said flue gas outlet;

said filter intake hoods extending into said scaffolding, said oil injection lance being removable from said coal-dust burner at a location said combustion air heater being positioned above said location where said oil injection lance is removable from said coal-dust burner for forming said oil injection lance from said coal-dust burner, said vertical distributor line entering said intake hood vertically, said intake hood extending into said scaffolding;

a single support for said scaffolding at a location facing said electric filter, said electric filter having a longitudinal axis with a geometrical projection of the longitudinal axis, said single supporting being arranged in said geometrical projection of the longitudinal axis half-way between the filter-intake hoods, said housing communicating upstream with a rear wall of said combustion-air heater;

said steam generator being a columnar boiler; said coal-dust burners being stacked between opposing walls of said combustion chamber;

said housing having a cylindrical shape with a rotor having inertial masses;

said scaffolding being attached to another scaffolding supporting the steam generator;

said combustion air heater being located above an uppermost coal-dust burner and above said lances so that said lances are removable for maintenance;

said combustion air heater being located next to one of said walls, said scaffolding being as tall as a distance between a rear wall of combustion air heater and an axis of a support supporting said other scaffolding; said housing communicating upstream closely with said rear wall of said combustion air heater, said vertically upright distributor reducing friction and energy of gas flow from the steam generator.

* * * * *